US007292198B2

(12) United States Patent
Shtrom et al.

(10) Patent No.: US 7,292,198 B2
(45) Date of Patent: Nov. 6, 2007

(54) SYSTEM AND METHOD FOR AN OMNIDIRECTIONAL PLANAR ANTENNA APPARATUS WITH SELECTABLE ELEMENTS

(75) Inventors: Victor Shtrom, Sunnyvale, CA (US); William S. Kish, Saratoga, CA (US)

(73) Assignee: Ruckus Wireless, Inc., Sunnyvale, CA (US)

( * ) Notice: Subject to any disclaimer, the term of this patent is extended or adjusted under 35 U.S.C. 154(b) by 0 days.

(21) Appl. No.: 11/010,076

(22) Filed: Dec. 9, 2004

(65) Prior Publication Data

US 2006/0038734 A1 Feb. 23, 2006

Related U.S. Application Data

(60) Provisional application No. 60/602,711, filed on Aug. 18, 2004, provisional application No. 60/603,157, filed on Aug. 18, 2004.

(51) Int. Cl.
*H01Q 9/28* (2006.01)
*H01Q 21/26* (2006.01)

(52) U.S. Cl. ..... 343/795; 343/700 MS; 343/797; 343/846; 343/853; 343/844; 343/742

(58) Field of Classification Search ..... 343/700 MS, 343/702, 820, 727, 793–795, 846, 853, 810, 343/833, 815, 817
See application file for complete search history.

(56) References Cited

U.S. PATENT DOCUMENTS 4,176,356 A 11/1979 Foster et al.
4,193,077 A 3/1980 Greenberg et al.
4,305,052 A * 12/1981 Baril et al. ..... 333/164
4,814,777 A * 3/1989 Monser ..... 343/727
5,173,711 A * 12/1992 Takeuchi et al. ..... 343/700 MS
5,220,340 A * 6/1993 Shafai ..... 343/895
5,754,145 A * 5/1998 Evans ..... 343/795

(Continued)

FOREIGN PATENT DOCUMENTS

EP 0534612 3/1993

(Continued)

OTHER PUBLICATIONS

U.S. Appl. No. 11/022,080, filed Dec. 23, 2004, Victor Shtrom, Circuit Board Having a Peripheral Antenna Apparatus with Selectable Antenna Elements.

(Continued)

*Primary Examiner*—Tho Phan
*Assistant Examiner*—Chuc Tran
(74) *Attorney, Agent, or Firm*—Carr & Ferrell LLP

(57) ABSTRACT

A system and method for a wireless link to a remote receiver includes a communication device for generating RF and a planar antenna apparatus for transmitting the RF. The planar antenna apparatus includes selectable antenna elements, each of which has gain and a directional radiation pattern. The directional radiation pattern is substantially in the plane of the antenna apparatus. Switching different antenna elements results in a configurable radiation pattern. Alternatively, selecting all or substantially all elements results in an omnidirectional radiation pattern. One or more directors and/or one or more reflectors may be included to constrict the directional radiation pattern. The antenna apparatus may be conformally mounted to a housing containing the communication device and the antenna apparatus.

42 Claims, 5 Drawing Sheets

U.S. PATENT DOCUMENTS

| | | | | |
|---|---|---|---|---|
| 5,767,809 | A | 6/1998 | Chuang et al. | |
| 6,034,638 | A | 3/2000 | Thiel et al. | |
| 6,094,177 | A | 7/2000 | Yamamoto | |
| 6,266,528 | B1 | 7/2001 | Farzaneh | |
| 6,292,153 | B1 * | 9/2001 | Aiello et al. | 343/767 |
| 6,307,524 | B1 | 10/2001 | Britain | |
| 6,326,922 | B1 | 12/2001 | Hegendoerfer | |
| 6,337,628 | B2 | 1/2002 | Campana, Jr. | |
| 6,337,668 | B1 | 1/2002 | Ito et al. | |
| 6,339,404 | B1 * | 1/2002 | Johnson et al. | 343/794 |
| 6,356,242 | B1 * | 3/2002 | Ploussios | 343/795 |
| 6,356,243 | B1 | 3/2002 | Schneider et al. | |
| 6,377,227 | B1 * | 4/2002 | Zhu et al. | 343/795 |
| 6,392,610 | B1 | 5/2002 | Braun et al. | |
| 6,404,386 | B1 | 6/2002 | Proctor, Jr. et al. | |
| 6,407,719 | B1 | 6/2002 | Ohira et al. | |
| 6,445,688 | B1 | 9/2002 | Garces et al. | |
| 6,498,589 | B1 | 12/2002 | Horii | |
| 6,507,321 | B2 | 1/2003 | Oberschmidt et al. | |
| 6,753,814 | B2 | 6/2004 | Killen et al. | |
| 6,762,723 | B2 | 7/2004 | Nallo et al. | |
| 6,819,287 | B2 * | 11/2004 | Sullivan et al. | 343/700 MS |
| 6,876,280 | B2 * | 4/2005 | Nakano | 333/262 |
| 6,888,504 | B2 * | 5/2005 | Chiang et al. | 343/702 |
| 6,906,678 | B2 * | 6/2005 | Chen | 343/795 |
| 6,924,768 | B2 * | 8/2005 | Wu et al. | 343/702 |
| 6,950,019 | B2 * | 9/2005 | Bellone et al. | 340/539.11 |
| 6,961,028 | B2 | 11/2005 | Joy et al. | |
| 6,975,834 | B1 * | 12/2005 | Forster | 455/277.2 |
| 7,034,770 | B2 | 4/2006 | Yang et al. | |
| 7,064,717 | B2 | 6/2006 | Kaluzni et al. | |
| 2002/0047800 | A1 | 4/2002 | Proctor, Jr. et al. | |
| 2002/0084942 | A1 | 7/2002 | Tsai et al. | |
| 2002/0105471 | A1 | 8/2002 | Kojima et al. | |
| 2002/0158798 | A1 | 10/2002 | Chiang et al. | |
| 2003/0030588 | A1 | 2/2003 | Kalis et al. | |
| 2003/0122714 | A1 | 7/2003 | Wannagot et al. | |
| 2003/0184490 | A1 | 10/2003 | Raiman et al. | |
| 2003/0189514 | A1 | 10/2003 | Miyano et al. | |
| 2003/0189521 | A1 | 10/2003 | Yamamoto et al. | |
| 2003/0189523 | A1 | 10/2003 | Ojantakanen et al. | |
| 2003/0210207 | A1 | 11/2003 | Suh et al. | |
| 2003/0227414 | A1 | 12/2003 | Saliga et al. | |
| 2004/0014432 | A1 | 1/2004 | Boyle | |
| 2004/0017310 | A1 | 1/2004 | Runkle et al. | |
| 2004/0017860 | A1 | 1/2004 | Liu | |
| 2004/0027291 | A1 | 2/2004 | Zhang et al. | |
| 2004/0027304 | A1 | 2/2004 | Chiang et al. | |
| 2004/0032378 | A1 | 2/2004 | Volman et al. | |
| 2004/0036651 | A1 | 2/2004 | Toda | |
| 2004/0036654 | A1 | 2/2004 | Hsieh | |
| 2004/0041732 | A1 | 3/2004 | Aikawa et al. | |
| 2004/0048593 | A1 | 3/2004 | Sano | |
| 2004/0058690 | A1 | 3/2004 | Ratzel et al. | |
| 2004/0061653 | A1 | 4/2004 | Webb et al. | |
| 2004/0070543 | A1 | 4/2004 | Masaki | |
| 2004/0080455 | A1 | 4/2004 | Lee | |
| 2004/0095278 | A1 | 5/2004 | Kanemoto et al. | |
| 2004/0114535 | A1 | 6/2004 | Hoffmann et al. | |

FOREIGN PATENT DOCUMENTS

| | | |
|---|---|---|
| WO | WO 03/079484 | 9/2003 |

OTHER PUBLICATIONS

U.S. Appl. No. 11/041,145, filed Jan. 21, 2005, Victor Shtrom, System and Method for a Minimized Antenna Apparatus with Selectable Elements.

* cited by examiner

SYSTEM AND METHOD FOR AN OMNIDIRECTIONAL PLANAR ANTENNA APPARATUS WITH SELECTABLE ELEMENTS

CROSS-REFERENCE TO RELATED APPLICATIONS

This application claims the benefit of U.S. Provisional Application No. 60/602,711 titled "Planar Antenna Apparatus for Isotropic Coverage and QoS Optimization in Wireless Networks," filed Aug. 18, 2004, which is hereby incorporated by reference; and U.S. Provisional Application No. 60/603,157 titled "Software for Controlling a Planar Antenna Apparatus for Isotropic Coverage and QoS Optimization in Wireless Networks," filed Aug. 18, 2004, which is hereby incorporated by reference.

BACKGROUND OF INVENTION

1. Field of the Invention

The present invention relates generally to wireless communications networks, and more particularly to a system and method for an omnidirectional planar antenna apparatus with selectable elements.

2. Description of the Prior Art

In communications systems, there is an ever-increasing demand for higher data throughput, and a corresponding drive to reduce interference that can disrupt data communications. For example, in an IEEE 802.11 network, an access point (i.e., base station) communicates data with one or more remote receiving nodes (e.g., a network interface card) over a wireless link. The wireless link may be susceptible to interference from other access points, other radio transmitting devices, changes or disturbances in the wireless link environment between the access point and the remote receiving node, and so on. The interference may be such to degrade the wireless link, for example by forcing communication at a lower data rate, or may be sufficiently strong to completely disrupt the wireless link.

One solution for reducing interference in the wireless link between the access point and the remote receiving node is to provide several omnidirectional antennas for the access point, in a "diversity" scheme. For example, a common configuration for the access point comprises a data source coupled via a switching network to two or more physically separated omnidirectional antennas. The access point may select one of the omnidirectional antennas by which to maintain the wireless link. Because of the separation between the omnidirectional antennas, each antenna experiences a different signal environment, and each antenna contributes a different interference level to the wireless link. The switching network couples the data source to whichever of the omnidirectional antennas experiences the least interference in the wireless link.

However, one problem with using two or more omnidirectional antennas for the access point is that typical omnidirectional antennas are vertically polarized. Vertically polarized radio frequency (RF) energy does not travel as efficiently as horizontally polarized RF energy inside a typical office or dwelling space, additionally, most of the laptop computer wireless cards have horizontally polarized antennas. Typical solutions for creating horizontally polarized RF antennas to date have been expensive to manufacture, or do not provide adequate RF performance to be commercially successful.

A further problem is that the omnidirectional antenna typically comprises an upright wand attached to a housing of the access point. The wand typically comprises a hollow metallic rod exposed outside of the housing, and may be subject to breakage or damage. Another problem is that each omnidirectional antenna comprises a separate unit of manufacture with respect to the access point, thus requiring extra manufacturing steps to include the omnidirectional antennas in the access point.

A still further problem with the two or more omnidirectional antennas is that because the physically separated antennas may still be relatively close to each other, each of the several antennas may experience similar levels of interference and only a relatively small reduction in interference may be gained by switching from one omnidirectional antenna to another omnidirectional antenna.

Another solution to reduce interference involves beam steering with an electronically controlled phased array antenna. However, the phased array antenna can be extremely expensive to manufacture. Further, the phased array antenna can require many phase tuning elements that may drift or otherwise become maladjusted.

SUMMARY OF INVENTION

An antenna apparatus comprises a substrate having a first side and a second side substantially parallel to the first side. Each of a plurality of antenna elements on the first side are configured to be selectively coupled to a communication device and form a first portion of a modified dipole having a directional radiation pattern. A ground component on the second side is configured to form a second portion of the modified dipole. In some embodiments, each of the plurality of antenna elements is on the same side of the substrate.

In some embodiments, an antenna element selecting device may selectively couple one or more of the antenna elements to the communication device. The antenna apparatus may form an omnidirectional radiation pattern when two or more of the antenna elements are coupled to the communication device. The antenna element may comprise one or more reflectors and/or directors configured to concentrate the directional radiation pattern of one or more of the modified dipoles. A combined radiation pattern resulting from two or more antenna elements being coupled to the communication device may be more directional or less directional than the radiation pattern of a single antenna element. The combined radiation pattern may also be offset in direction. The plurality of antenna elements may be conformally mounted to a housing containing the communication device and the antenna apparatus.

A system comprises a communication device for generating a radio frequency signal, a first means for generating a first directional radiation pattern, a second means for generating a second directional radiation pattern, and a selecting means for receiving a radio frequency signal from the communication device and selectively coupling the first means and/or the second means to the communication device. The second directional radiation pattern may be offset in direction from the first directional radiation pattern. In some embodiments, the second directional radiation pattern may be more directional than the first directional radiation pattern, less directional than the first directional radiation pattern, or offset in direction and directivity as the first directional radiation pattern. The first means and the second means may form an omnidirectional radiation pattern when coupled to the communication device. The system may include means for concentrating the directional radiation pattern of the first means.

A method comprises generating the radio frequency signal in the communication device and coupling at least one of the plurality of coplanar antenna elements to the communication device to result in the directional radiation pattern substantially in the plane of the antenna elements. The method may comprise coupling two or more of the plurality of coplanar antenna elements to the communication device to result in an omnidirectional radiation pattern. The method may comprise concentrating the directional radiation pattern with one or more directors and/or reflectors. Coupling at least one of the plurality of coplanar antenna elements to the communication device may comprise biasing a PIN diode or virtually any other means of switching RF energy. The method may comprise coupling at least two of the plurality of coplanar antenna elements to the communication device to result in a more directional radiation pattern. The method may further comprise coupling at least two of the plurality of coplanar antenna elements to the communication device to result in a less directional radiation pattern.

BRIEF DESCRIPTION OF DRAWINGS

The present invention will now be described with reference to drawings that represent a preferred embodiment of the invention. In the drawings, like components have the same reference numerals. The illustrated embodiment is intended to illustrate, but not to limit the invention. The drawings include the following figures.

DETAILED DESCRIPTION

A system for a wireless (i.e., radio frequency or RF) link to a remote receiving device includes a communication device for generating an RF signal and a planar antenna apparatus for transmitting and/or receiving the RF signal. The planar antenna apparatus includes selectable antenna elements. Each of the antenna elements provides gain (with respect to isotropic) and a directional radiation pattern substantially in the plane of the antenna elements. Each antenna element may be electrically selected (e.g., switched on or off) so that the planar antenna apparatus may form a configurable radiation pattern. If all elements are switched on, the planar antenna apparatus forms an omnidirectional radiation pattern. In some embodiments, if two or more of the elements is switched on, the planar antenna apparatus may form a substantially omnidirectional radiation pattern.

Advantageously, the system may select a particular configuration of selected antenna elements that minimizes interference over the wireless link to the remote receiving device. If the wireless link experiences interference, for example due to other radio transmitting devices, or changes or disturbances in the wireless link between the system and the remote receiving device, the system may select a different configuration of selected antenna elements to change the resulting radiation pattern and minimize the interference. The system may select a configuration of selected antenna elements corresponding to a maximum gain between the system and the remote receiving device. Alternatively, the system may select a configuration of selected antenna elements corresponding to less than maximal gain, but corresponding to reduced interference in the wireless link.

As described further herein, the planar antenna apparatus radiates the directional radiation pattern substantially in the plane of the antenna elements. When mounted horizontally, the RF signal transmission is horizontally polarized, so that RF signal transmission indoors is enhanced as compared to a vertically polarized antenna. The planar antenna apparatus is easily manufactured from common planar substrates such as an FR4 printed circuit board (PCB). Further, the planar antenna apparatus may be integrated into or conformally mounted to a housing of the system, to minimize cost and to provide support for the planar antenna apparatus.

Figure 1:
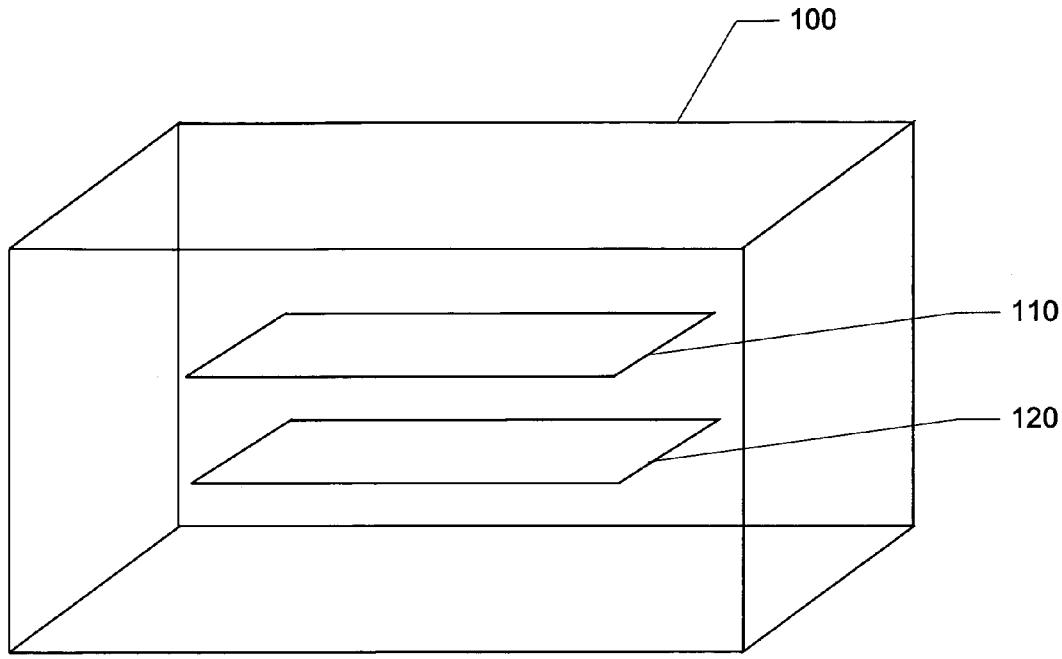
FIG. 1 illustrates a system comprising an omnidirectional planar antenna apparatus with selectable elements, in one embodiment in accordance with the present invention.

FIG. 1 illustrates a system 100 comprising an omnidirectional planar antenna apparatus with selectable elements, in one embodiment in accordance with the present invention. The system 100 may comprise, for example without limitation, a transmitter and/or a receiver, such as an 802.11 access point, an 802.11 receiver, a set-top box, a laptop computer, a television, a PCMCIA card, a remote control, and a remote terminal such as a handheld gaming device. In some exemplary embodiments, the system 100 comprises an access point for communicating to one or more remote receiving nodes (not shown) over a wireless link, for example in an 802.11 wireless network. Typically, the system 100 may receive data from a router connected to the Internet (not shown), and the system 100 may transmit the data to one or more of the remote receiving nodes. The system 100 may also form a part of a wireless local area network by enabling communications among several remote receiving nodes. Although the disclosure will focus on a specific embodiment for the system 100, aspects of the invention are applicable to a wide variety of appliances, and are not intended to be limited to the disclosed embodiment. For example, although the system 100 may be described as transmitting to the remote receiving node via the planar antenna apparatus, the system 100 may also receive data from the remote receiving node via the planar antenna apparatus.

The system 100 includes a communication device 120 (e.g., a transceiver) and a planar antenna apparatus 110. The communication device 120 comprises virtually any device for generating and/or receiving an RF signal. The communication device 120 may include, for example, a radio modulator/demodulator for converting data received into the system 100 (e.g., from the router) into the RF signal for transmission to one or more of the remote receiving nodes. In some embodiments, for example, the communication device 120 comprises well-known circuitry for receiving data packets of video from the router and circuitry for converting the data packets into 802.11 compliant RF signals.

As described further herein, the planar antenna apparatus 110 comprises a plurality of individually selectable planar antenna elements. Each of the antenna elements has a directional radiation pattern with gain (as compared to an omnidirectional antenna). Each of the antenna elements also has a polarization substantially in the plane of the planar antenna apparatus 110. The planar antenna apparatus 110 may include an antenna element selecting device configured to selectively couple one or more of the antenna elements to the communication device 120.

Figure 2A:
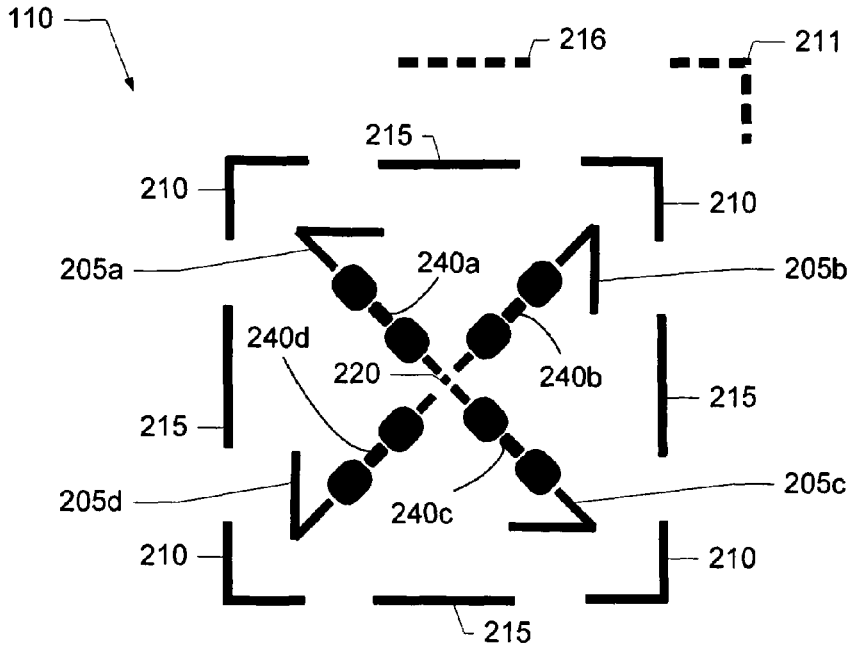
FIG. 2A and FIG. 2B illustrate the planar antenna apparatus of FIG. 1, in one embodiment in accordance with the present invention.
Figure 2B:
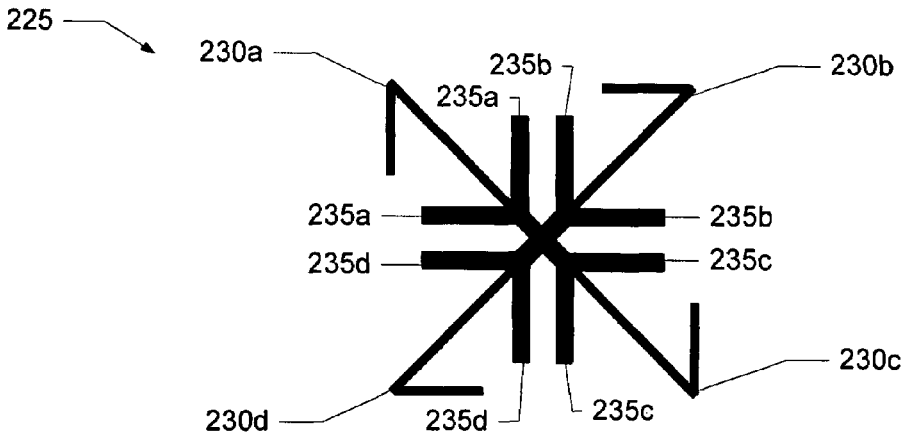

FIG. 2A and FIG. 2B illustrate the planar antenna apparatus 110 of FIG. 1, in one embodiment in accordance with the present invention. The planar antenna apparatus 110 of this embodiment includes a substrate (considered as the plane of FIGS. 2A and 2B) having a first side (e.g., FIG. 2A) and a second side (e.g., FIG. 2B) substantially parallel to the first side. In some embodiments, the substrate comprises a PCB such as FR4, Rogers 4003, or other dielectric material.

On the first side of the substrate, the planar antenna apparatus 110 of FIG. 2A includes a radio frequency feed port 220 and four antenna elements 205*a*-205*d*. As described with respect to FIG. 4, although four antenna elements are depicted, more or fewer antenna elements are contemplated. Although the antenna elements 205*a*-205*d* of FIG. 2A are oriented substantially on diagonals of a square shaped planar antenna so as to minimize the size of the planar antenna apparatus 110, other shapes are contemplated. Further, although the antenna elements 205*a*-205*d* form a radially symmetrical layout about the radio frequency feed port 220, a number of non-symmetrical layouts, rectangular layouts, and layouts symmetrical in only one axis, are contemplated. Furthermore, the antenna elements 205*a*-205*d* need not be of identical dimension, although depicted as such in FIG. 2A.

On the second side of the substrate, as shown in FIG. 2B, the planar antenna apparatus 110 includes a ground component 225. It will be appreciated that a portion (e.g., the portion 230*a*) of the ground component 225 is configured to form an arrow-shaped bent dipole in conjunction with the antenna element 205*a*. The resultant bent dipole provides a directional radiation pattern substantially in the plane of the planar antenna apparatus 110, as described further with respect to FIG. 3.

Figure 2C:
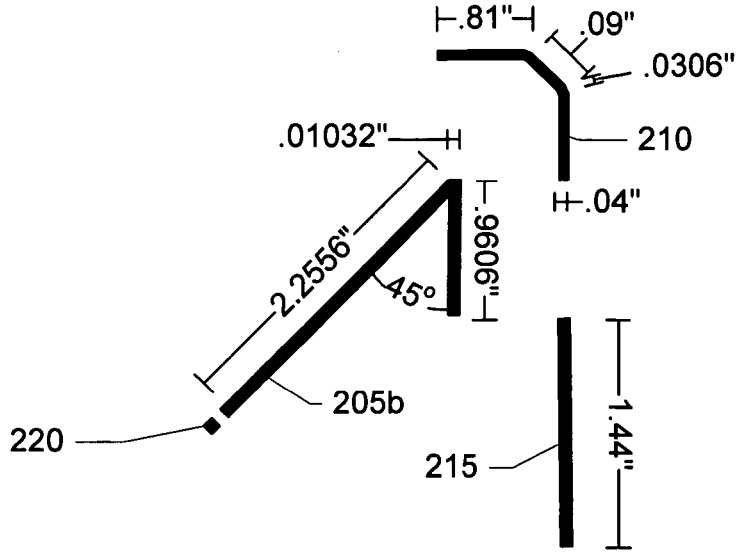
FIGS. 2C and 2D illustrate dimensions for several components of the planar antenna apparatus of FIG. 1, in one embodiment in accordance with the present invention.
Figure 2D:
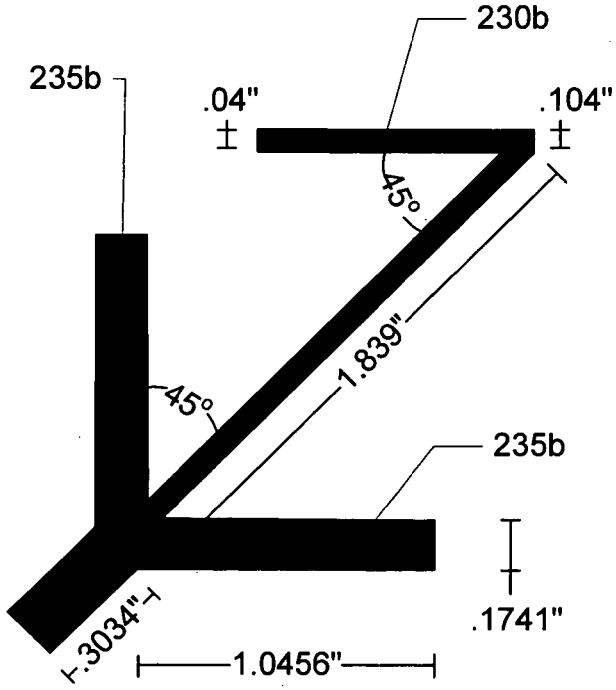

FIGS. 2C and 2D illustrate dimensions for several components of the planar antenna apparatus 110, in one embodiment in accordance with the present invention. It will be appreciated that the dimensions of the individual components of the planar antenna apparatus 110 (e.g., the antenna element 205*a*, the portion 230*a* of the ground component 205) depend upon a desired operating frequency of the planar antenna apparatus 110. The dimensions of the individual components may be established by use of RF simulation software, such as IE3D from Zeland Software of Fremont, Calif. For example, the planar antenna apparatus 110 incorporating the components of dimension according to FIGS. 2C and 2D is designed for operation near 2.4 GHz, based on a substrate PCB of Rogers 4003 material, but it will be appreciated by an antenna designer of ordinary skill that a different substrate having different dielectric properties, such as FR4, may require different dimensions than those shown in FIGS. 2C and 2D.

As shown in FIG. 2, the planar antenna apparatus 110 may optionally include one or more directors 210, one or more gain directors 215, and/or one or more Y-shaped reflectors 235 (e.g., the Y-shaped reflector 235*b* depicted in FIGS. 2B and 2D). The directors 210, the gain directors 215, and the Y-shaped reflectors 235 comprise passive elements that concentrate the directional radiation pattern of the dipoles formed by the antenna elements 205*a*-205*d* in conjunction with the portions 230*a*-230*d*. In one embodiment, providing a director 210 for each antenna element 205*a*-205*d* yields an additional 1-2 dB of gain for each dipole. It will be appreciated that the directors 210 and/or the gain directors 215 may be placed on either side of the substrate. In some embodiments, the portion of the substrate for the directors 210 and/or gain directors 215 is scored so that the directors 210 and/or gain directors 215 may be removed. It will also be appreciated that additional directors (depicted in a position shown by dashed line 211 for the antenna element 205*b*) and/or additional gain directors (depicted in a position shown by a dashed line 216) may be included to further concentrate the directional radiation pattern of one or more of the dipoles. The Y-shaped reflectors 235 will be further described herein.

The radio frequency feed port 220 is configured to receive an RF signal from and/or transmit an RF signal to the communication device 120 of FIG. 1. An antenna element selector (not shown) may be used to couple the radio frequency feed port 220 to one or more of the antenna elements 205*a*-205*d*. The antenna element selector may comprise an RF switch (not shown), such as a PIN diode, a GaAs FET, or virtually any RF switching device, as is well known in the art.

In the embodiment of FIG. 2A, the antenna element selector comprises four PIN diodes, 240*a*-240*d*, each PIN diode 240*a*-240*d* connecting one of the antenna elements 205*a*-205*d* to the radio frequency feed port 220. In this embodiment, the PIN diode comprises a single-pole single-throw switch to switch each antenna element either on or off (i.e., couple or decouple each of the antenna elements 205*a*-205*d* to the radio frequency feed port 220). In one embodiment, a series of control signals (not shown) is used to bias each PIN diode 240*a*-240*d*. With the PIN diode forward biased and conducting a DC current, the PIN diode switch is on, and the corresponding antenna element is selected. With the diode reverse biased, the PIN diode switch is off. In this embodiment, the radio frequency feed port 220 and the PIN diodes 240*a*-240*d* of the antenna element selector are on the side of the substrate with the antenna elements 205*a*-205*d*, however, other embodiments separate the radio frequency feed port 220, the antenna element selector, and the antenna elements 205*a*-205*d*. In some embodiments, the antenna element selector comprises one or more single-pole multiple-throw switches. In some embodiments, one or more light emitting diodes (not shown) are coupled to the antenna element selector as a visual indicator of which of the antenna elements 205*a*-205*d* is on or off. In one embodiment, a light emitting diode is placed in circuit with the PIN diode so that the light emitting diode is lit when the corresponding antenna element 205 is selected.

In some embodiments, the antenna components (e.g., the antenna elements 205*a*-205*d*, the ground component 225, the directors 210, and the gain directors 215) are formed from RF conductive material. For example, the antenna elements 205*a*-205*d* and the ground component 225 may be formed from metal or other RF conducting foil. Rather than being provided on opposing sides of the substrate as shown in FIGS. 2A and 2B, each antenna element 205*a*-205*d* is coplanar with the ground component 225. In some embodiments, the antenna components may be conformally mounted to the housing of the system 100. In such embodiments, the antenna element selector comprises a separate structure (not shown) from the antenna elements 205*a*-205*d*. The antenna element selector may be mounted on a relatively small PCB, and the PCB may be electrically coupled to the antenna elements 205*a*-205*d*. In some embodiments, the switch PCB is soldered directly to the antenna elements 205*a*-205*d*.

In the embodiment of FIG. 2B, the Y-shaped reflectors 235 (e.g., the reflectors 235*a*) may be included as a portion of the ground component 225 to broaden a frequency response (i.e., bandwidth) of the bent dipole (e.g., the antenna element 205*a* in conjunction with the portion 230*a* of the ground component 225). For example, in some embodiments, the planar antenna apparatus 110 is designed to operate over a frequency range of about 2.4 GHz to 2.4835 GHz, for wireless LAN in accordance with the IEEE 802.11 standard. The reflectors 235*a*-235*d* broaden the frequency response of each dipole to about 300 MHz (12.5% of the center frequency) to 500 MHz (~20% of the center frequency). The combined operational bandwidth of the planar antenna apparatus 110 resulting from coupling more than one of the antenna elements 205*a*-205*d* to the radio frequency feed port 220 is less than the bandwidth resulting from coupling only one of the antenna elements 205*a*-205*d* to the radio frequency feed port 220. For example, with all four antenna elements 205*a*-205*d* selected to result in an omnidirectional radiation pattern, the combined frequency response of the planar antenna apparatus 110 is about 90 MHz. In some embodiments, coupling more than one of the antenna elements 205*a*-205*d* to the radio frequency feed port 220 maintains a match with less than 10 dB return loss over 802.11 wireless LAN frequencies, regardless of the number of antenna elements 205*a*-205*d* that are switched on.

Figure 3A:
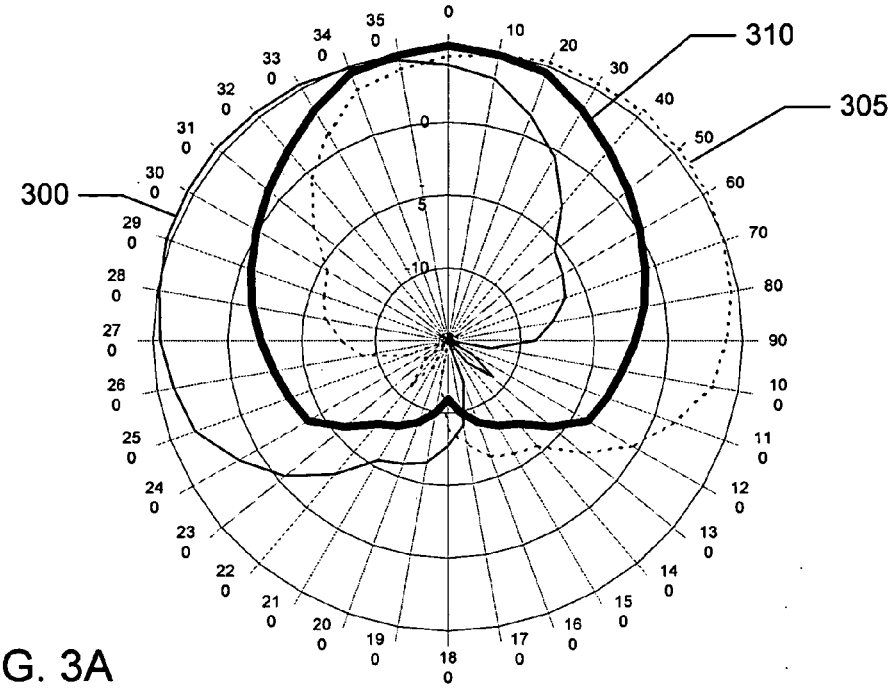
FIG. 3A illustrates various radiation patterns resulting from selecting different antenna elements of the planar antenna apparatus of FIG. 2, in one embodiment in accordance with the present invention.

FIG. 3A illustrates various radiation patterns resulting from selecting different antenna elements of the planar antenna apparatus 110 of FIG. 2, in one embodiment in accordance with the present invention. FIG. 3A depicts the radiation pattern in azimuth (e.g., substantially in the plane of the substrate of FIG. 2). A line 300 displays a generally cardioid directional radiation pattern resulting from selecting a single antenna element (e.g., the antenna element 205*a*). As shown, the antenna element 205*a* alone yields approximately 5 dBi of gain. A dashed line 305 displays a similar directional radiation pattern, offset by approximately 90 degrees, resulting from selecting an adjacent antenna element (e.g., the antenna element 205*b*). A line 310 displays a combined radiation pattern resulting from selecting the two adjacent antenna elements 205*a* and 205*b*. In this embodiment, enabling the two adjacent antenna elements 205*a* and 205*b* results in higher directionality in azimuth as compared to selecting either of the antenna elements 205*a* or 205*b* alone, with approximately 5.6 dBi gain.

The radiation pattern of FIG. 3A in azimuth illustrates how the selectable antenna elements 205*a*-205*d* may be combined to result in various radiation patterns for the planar antenna apparatus 110. As shown, the combined radiation pattern resulting from two or more adjacent antenna elements (e.g., the antenna element 205*a* and the antenna element 205*b*) being coupled to the radio frequency feed port is more directional than the radiation pattern of a single antenna element.

Not shown in FIG. 3A for improved legibility, is that the selectable antenna elements 205*a*-205*d* may be combined to result in a combined radiation pattern that is less directional than the radiation pattern of a single antenna element. For example, selecting all of the antenna elements 205*a*-205*d* results in a substantially omnidirectional radiation pattern that has less directionality than that of a single antenna element. Similarly, selecting two or more antenna elements (e.g., the antenna element 205*a* and the antenna element 205*c* on opposite diagonals of the substrate) may result in a substantially omnidirectional radiation pattern. In this fashion, selecting a subset of the antenna elements 205*a*-205*d*, or substantially all of the antenna elements 205*a*-205*d*, may result in a substantially omnidirectional radiation pattern for the planar antenna apparatus 110.

Although not shown in FIG. 3A, it will be appreciated that additional directors (e.g., the directors 211) and/or gain directors (e.g., the gain directors 216) may further concentrate the directional radiation pattern of one or more of the antenna elements 205*a*-205*d* in azimuth. Conversely, removing or eliminating one or more of the directors 211, the gain directors 216, or the Y-shaped reflectors 235 expands the directional radiation pattern of one or more of the antenna elements 205*a*-205*d* in azimuth.

FIG. 3A also shows how the planar antenna apparatus 110 may be advantageously configured, for example, to reduce interference in the wireless link between the system 100 of FIG. 1 and a remote receiving node. For example, if the remote receiving node is situated at zero degrees in azimuth relative to the system 100 (at the center of FIG. 3A), the antenna element 205*a* corresponding to the line 300 yields approximately the same gain in the direction of the remote receiving node as the antenna element 205*b* corresponding to the line 305. However, as can be seen by comparing the line 300 and the line 305, if an interferer is situated at twenty degrees of azimuth relative to the system 100, selecting the antenna element 205*a* yields approximately a 4 dB signal strength reduction for the interferer as opposed to selecting the antenna element 205*b*. Advantageously, depending on the signal environment around the system 100, the planar antenna apparatus 110 may be configured (e.g., by switching one or more of the antenna elements 205*a*-205*d* on or off) to reduce interference in the wireless link between the system 100 and one or more remote receiving nodes.

Figure 3B:
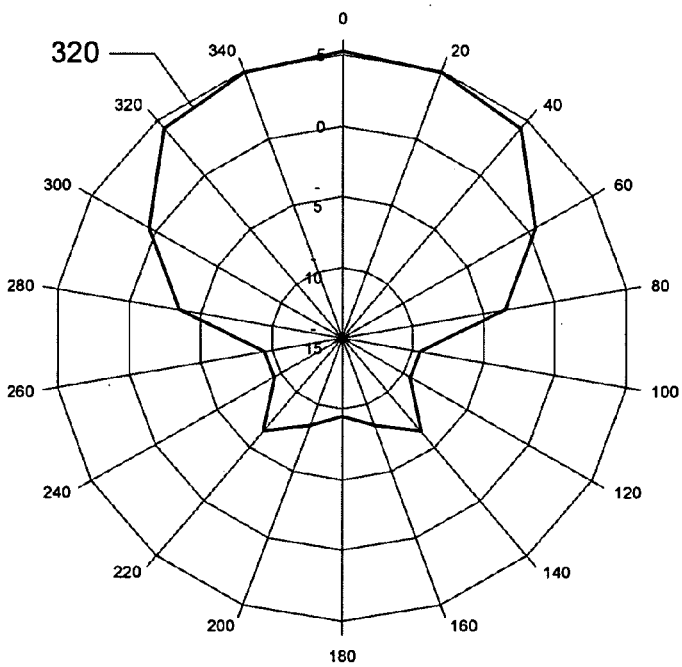
FIG. 3B illustrates an elevation radiation pattern for the planar antenna apparatus of FIG. 2, in one embodiment in accordance with the present invention.

FIG. 3B illustrates an elevation radiation pattern for the planar antenna apparatus 110 of FIG. 2. In the figure, the plane of the planar antenna apparatus 110 corresponds to a line from 0 to 180 degrees in the figure. Although not shown, it will be appreciated that additional directors (e.g., the directors 211) and/or gain directors (e.g., the gain directors 216) may advantageously further concentrate the radiation pattern of one or more of the antenna elements 205*a*-205*d* in elevation. For example, in some embodiments, the system 110 may be located on a floor of a building to establish a wireless local area network with one or more remote receiving nodes on the same floor. Including the additional directors 211 and/or gain directors 216 in the planar antenna apparatus 110 further concentrates the wireless link to substantially the same floor, and minimizes interference from RF sources on other floors of the building.

Figure 4A:
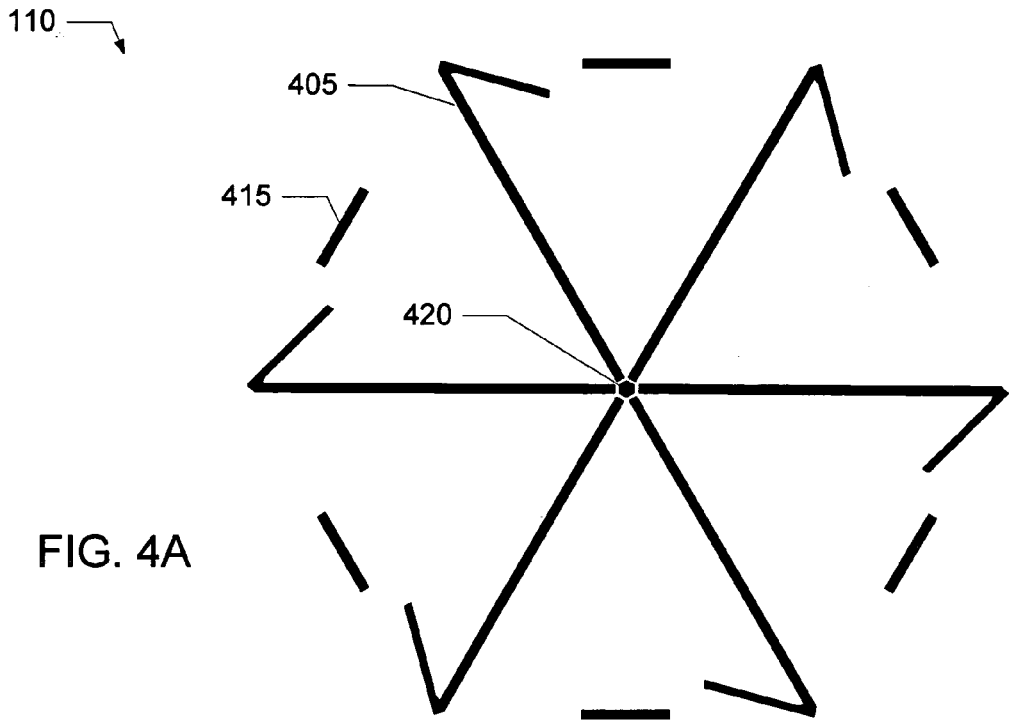
FIG. 4A and FIG. 4B illustrate an alternative embodiment of the planar antenna apparatus 110 of FIG. 1, in accordance with the present invention.
Figure 4B:
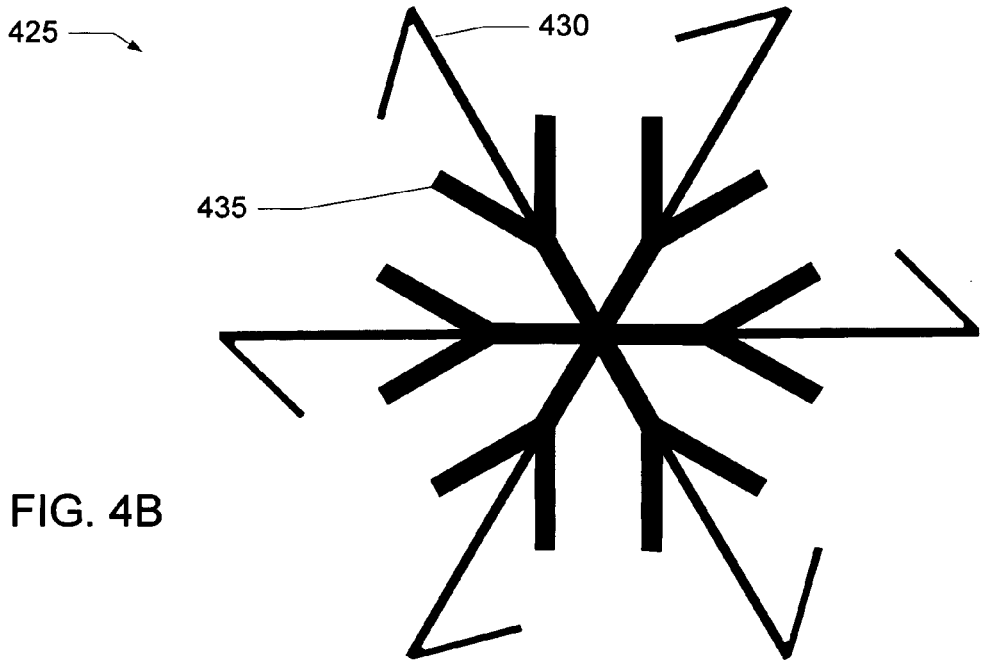

FIG. 4A and FIG. 4B illustrate an alternative embodiment of the planar antenna apparatus 110 of FIG. 1, in accordance with the present invention. On the first side of the substrate as shown in FIG. 4A, the planar antenna apparatus 110 includes a radio frequency feed port 420 and six antenna elements (e.g., the antenna element 405). On the second side of the substrate, as shown in FIG. 4B, the planar antenna apparatus 110 includes a ground component 425 incorporating a number of Y-shaped reflectors 435. It will be appreciated that a portion (e.g., the portion 430) of the ground component 425 is configured to form an arrow-shaped bent dipole in conjunction with the antenna element 405. Similarly to the embodiment of FIG. 2, the resultant bent dipole has a directional radiation pattern. However, in contrast to the embodiment of FIG. 2, the six antenna element embodiment provides a larger number of possible combined radiation patterns.

Similarly with respect to FIG. 2, the planar antenna apparatus 110 of FIG. 4 may optionally include one or more directors (not shown) and/or one or more gain directors 415. The directors and the gain directors 415 comprise passive elements that concentrate the directional radiation pattern of the antenna elements 405. In one embodiment, providing a director for each antenna element yields an additional 1-2 dB of gain for each element. It will be appreciated that the directors and/or the gain directors 415 may be placed on either side of the substrate. It will also be appreciated that additional directors and/or gain directors may be included to further concentrate the directional radiation pattern of one or more of the antenna elements 405.

An advantage of the planar antenna apparatus 110 of FIGS. 2-4 is that the antenna elements (e.g., the antenna elements 205*a*-205*d*) are each selectable and may be switched on or off to form various combined radiation patterns for the planar antenna apparatus 110. For example, the system 100 communicating over the wireless link to the remote receiving node may select a particular configuration of selected antenna elements that minimizes interference over the wireless link. If the wireless link experiences interference, for example due to other radio transmitting devices, or changes or disturbances in the wireless link between the system 100 and the remote receiving node, the system 100 may select a different configuration of selected antenna elements to change the radiation pattern of the planar antenna apparatus 110 and minimize the interference in the wireless link. The system 100 may select a configuration of selected antenna elements corresponding to a maximum gain between the system and the remote receiving node. Alternatively, the system may select a configuration of selected antenna elements corresponding to less than maximal gain, but corresponding to reduced interference. Alternatively, all or substantially all of the antenna elements may be selected to form a combined omnidirectional radiation pattern.

A further advantage of the planar antenna apparatus 110 is that RF signals travel better indoors with horizontally polarized signals. Typically, network interface cards (NICs) are horizontally polarized. Providing horizontally polarized signals with the planar antenna apparatus 110 improves interference rejection (potentially, up to 20 dB) from RF sources that use commonly-available vertically polarized antennas.

Another advantage of the system 100 is that the planar antenna apparatus 110 includes switching at RF as opposed to switching at baseband. Switching at RF means that the communication device 120 requires only one RF up/down converter. Switching at RF also requires a significantly simplified interface between the communication device 120 and the planar antenna apparatus 110. For example, the planar antenna apparatus provides an impedance match under all configurations of selected antenna elements, regardless of which antenna elements are selected. In one embodiment, a match with less than 10 dB return loss is maintained under all configurations of selected antenna elements, over the range of frequencies of the 802.11 standard, regardless of which antenna elements are selected.

A still further advantage of the system 100 is that, in comparison for example to a phased array antenna with relatively complex phase switching elements, switching for the planar antenna apparatus 110 is performed to form the combined radiation pattern by merely switching antenna elements on or off. No phase variation, with attendant phase matching complexity, is required in the planar antenna apparatus 110.

Yet another advantage of the planar antenna apparatus 110 on PCB is that the planar antenna apparatus 110 does not require a 3-dimensional manufactured structure, as would be required by a plurality of "patch" antennas needed to form an omnidirectional antenna. Another advantage is that the planar antenna apparatus 110 may be constructed on PCB so that the entire planar antenna apparatus 110 can be easily manufactured at low cost. One embodiment or layout of the planar antenna apparatus 110 comprises a square or rectangular shape, so that the planar antenna apparatus 110 is easily panelized.

The invention has been described herein in terms of several preferred embodiments. Other embodiments of the invention, including alternatives, modifications, permutations and equivalents of the embodiments described herein, will be apparent to those skilled in the art from consideration of the specification, study of the drawings, and practice of the invention. The embodiments and preferred features described above should be considered exemplary, with the invention being defined by the appended claims, which therefore include all such alternatives, modifications, permutations and equivalents as fall within the true spirit and scope of the present invention.

What is claimed is:

1. An antenna apparatus, comprising:

a substrate having a first side and a second side substantially parallel to the first side;

a plurality of active antenna elements on the first side of the substrate, each active antenna element selectively coupled to a communication device and configured to form a first portion of a modified dipole having a directional radiation pattern with polarization substantially in the plane of the substrate; and a ground component on the second side of the substrate, the ground component being asymmetrically configured on a planar axis, the ground component being further configured to form a second portion of the modified dipole.

2. The antenna apparatus of claim 1, further comprising an antenna element selector coupled to each active antenna element, the antenna element selector configured to selectively couple the active antenna element to the communication device.

3. The antenna apparatus of claim 2, wherein the antenna element selector comprises a PIN diode.

4. The antenna apparatus of claim 2, further comprising a visual indicator coupled to the antenna element selector, the visual indicator configured to indicate which of the active antenna elements is selected.

5. The antenna apparatus of claim 1, wherein the ground component is further configured to concentrate the directional radiation pattern of the modified dipole.

6. The antenna apparatus of claim 1, wherein the ground component is further configured to broaden a frequency response of the modified dipole.

7. The antenna apparatus of claim 1, wherein a match with less than 10 dB return loss is maintained when more than one active antenna element is coupled to the communication device.

8. The antenna apparatus of claim 1, wherein the modified dipole comprises an arrow-shaped bent dipole.

9. The antenna apparatus of claim 1, wherein the plurality of active antenna elements has an omnidirectional radiation pattern when two or more of the active antenna elements are coupled to the communication device.

10. The antenna apparatus of claim 1, wherein the substrate comprises a substantially rectangular surface and each of the active antenna elements is oriented substantially on one of the diagonals of the substrate.

11. The antenna apparatus of claim 1, wherein the substrate comprises a printed circuit board.

12. The antenna apparatus of claim 1, wherein the substrate comprises a dielectric, and the active antenna elements and the ground component are formed on the dielectric.

13. The antenna apparatus of claim 1, further comprising one or more reflectors for at least one of the active antenna elements, the reflector configured to concentrate the radiation pattern of the active antenna element.

14. The antenna apparatus of claim 1, further comprising one or more Y-shaped reflectors for at least one of the active antenna elements, the Y-shaped reflector configured to concentrate the radiation pattern of the active antenna element.

15. The antenna apparatus of claim 1, further comprising one or more directors, each director configured to concentrate the radiation pattern of the active antenna element.

16. The antenna apparatus of claim 1, wherein a combined radiation pattern resulting from two or more active antenna elements being coupled to the communication device is more directional than the radiation pattern of a single active antenna element.

17. The antenna apparatus of claim 1, wherein a combined radiation pattern resulting from two or more active antenna elements being coupled to the communication device is less directional than the radiation pattern of a single active antenna element.

18. An antenna apparatus, comprising:

a plurality of individually selectable active planar antenna elements, each active antenna element having a directional radiation pattern with polarization substantially in the plane of the active antenna elements;

a ground component which is asymmetrically configured on a planar axis; and an antenna element selecting device configured to communicate a radio frequency signal with a communication device and selectively couple one or more of the active antenna elements to the communication device.

19. The antenna apparatus of claim 18, wherein the plurality of active antenna elements are formed from radio frequency conducting material coupled to the active antenna element selecting device.

20. The antenna apparatus of claim 19, wherein the radio frequency conducting material comprises a metal foil.

21. The antenna apparatus of claim 18, wherein the active antenna element selecting device comprises a PIN diode for each active antenna element.

22. The antenna apparatus of claim 18, wherein the active antenna element selecting device comprises a single-pole single-throw RF switch for each active antenna element.

23. The antenna apparatus of claim 18, further comprising a visual indicator coupled to the active antenna element selecting device, the visual indicator configured to indicate whether each active antenna element is selectively coupled to the communication device.

24. The antenna apparatus of claim 18, wherein the plurality of active antenna elements are configured to be conformally mounted to a housing containing the communication device and the antenna apparatus.

25. The antenna apparatus of claim 18, wherein one or more of the plurality of active antenna elements comprises means for concentrating the radiation pattern of the active antenna element.

26. The antenna apparatus of claim 18, wherein the plurality of active antenna elements form an omnidirectional radiation pattern when two or more of the active antenna elements are coupled to the communication device.

27. An antenna apparatus, comprising:

a communication device for generating a radio frequency signal;

a first means for generating a first directional radiation pattern;

a second means for generating a second radiation pattern, the second radiation pattern being offset in direction from the first directional radiation pattern;

a third means for grounding the system, the third means being configured in an asymmetrical pattern with respect to a planar axis of the third means; and a selecting means for receiving the radio frequency signal from the communication device and selectively coupling the first means and the second means to the communication device.

28. The antenna apparatus of claim 27, wherein a match with less than 10 dB return loss is maintained when the first means and the second means are both coupled to the communication device.

29. The antenna apparatus of claim 27, further comprising means for expanding the directional radiation pattern of the first means.

30. The antenna apparatus of claim 27, wherein the first means and the second means form an omnidirectional radiation pattern when coupled to the communication device.

31. The antenna apparatus of claim 27, further comprising means for concentrating the directional radiation pattern of the first means.

32. The antenna apparatus of claim 27, further comprising means for expanding the directional radiation pattern of the first means.

33. A method, comprising:

generating a radio frequency signal in a communication device; and selectively coupling at least one of a plurality of active coplanar antenna elements to the communication device to result in a directional radiation pattern substantially in the plane of the active antenna elements, wherein at least one of the plurality of active coplanar antenna elements comprises a portion of a dipole, and selectively coupling the at least one of the plurality of active coplanar antenna elements comprises enabling the portion of the dipole to receive the radio frequency signal from the communication device and enabling a ground component to complete the dipole, the ground component being asymmetrically configured relative to a planar axis defined by the ground component.

34. The method of clan 33, wherein the dipole comprises a bent dipole.

35. The method of claim 33, further comprising coupling two or more of the plurality of active planar antenna elements to the communication device to result in an omnidirectional radiation pattern.

36. The method of claim 33, further comprising concentrating the directional radiation pattern with one or more reflectors.

37. The method of claim 33, further comprising concentrating the directional radiation pattern with one or more Y-shaped reflectors.

38. The method of claim 33, further comprising concentrating the directional radiation pattern with one or more directors.

39. The method of claim 33, wherein coupling at least one of the plurality of active coplanar antenna elements to the communication device comprises biasing a PIN diode.

40. The method of claim 33, further comprising coupling at least two of the active plurality of coplanar antenna elements to the communication device to result in a more directional radiation pattern.

41. The method of claim 33, further comprising coupling at least two of the plurality of active coplanar antenna elements to the communication device to result in a less directional radiation pattern.

42. The method of claim 33, further comprising coupling at least two of the plurality of active coplanar antenna elements to the communication device to result in a radiation pattern in an offset direction from the original.

* * * * *